US010182470B2

(12) United States Patent
Habata et al.

(10) Patent No.: US 10,182,470 B2
(45) Date of Patent: Jan. 15, 2019

(54) CERAMIC HEATER HAVING ENLARGED WINDWARD AREA

(71) Applicant: BETACERA INC., New Taipei (TW)

(72) Inventors: Etsuro Habata, New Taipei (TW); Chih-Chang Wei, New Taipei (TW)

(73) Assignee: BETACERA INC., New Taipei (TW)

( * ) Notice: Subject to any disclaimer, the term of this patent is extended or adjusted under 35 U.S.C. 154(b) by 680 days.

(21) Appl. No.: 14/827,987

(22) Filed: Aug. 17, 2015

(65) Prior Publication Data

US 2017/0055316 A1 Feb. 23, 2017

(51) Int. Cl.

| | |
|---|---|
| ***F24H 3/00*** | (2006.01) |
| ***H05B 3/03*** | (2006.01) |
| ***H05B 3/30*** | (2006.01) |
| ***H05B 3/14*** | (2006.01) |
| ***H05B 3/24*** | (2006.01) |
| ***F24H 3/04*** | (2006.01) |

(52) U.S. Cl.

CPC ..... *H05B 3/141* (2013.01); *F24H 3/0447* (2013.01); *H05B 3/03* (2013.01); *H05B 3/24* (2013.01); *H05B 2203/016* (2013.01); *H05B 2203/02* (2013.01); *H05B 2203/023* (2013.01)

(58) Field of Classification Search

CPC ..... F24H 3/0447

See application file for complete search history.

(56) References Cited

U.S. PATENT DOCUMENTS

| | | | | |
|---|---|---|---|---|
| 2007/0068914 A1* | 3/2007 | Zeyen | F24H 3/0429 219/201 |
| 2011/0056927 A1* | 3/2011 | Wu | H05B 3/50 219/540 |
| 2015/0156822 A1* | 6/2015 | Gries | H05B 3/50 219/540 |

FOREIGN PATENT DOCUMENTS

| | | | | |
|---|---|---|---|---|
| EP | 1503153 A1 * | 2/2005 | F24H 3/0405 |
| EP | 2730854 A1 * | 5/2014 | H05B 3/24 |
| EP | 3073801 A1 * | 9/2016 | B60H 1/2215 |
| EP | 3136820 A1 * | 3/2017 | H05B 3/14 |
| WO | WO 2007135644 A1 * | 11/2007 | F24H 3/0405 |

* cited by examiner

*Primary Examiner* — Joseph M Pelham

(74) *Attorney, Agent, or Firm* — Chun-Ming Shih; HDLS IPR Services

(57) ABSTRACT

A ceramic heater having an enlarged windward area includes a conductive heat sink, at least one positive temperature coefficient (PTC) heating element, and an electrode plate. The conductive heat sink includes a cooling fin. The at least one PCT heating element is disposed on one side of the cooling fin. The electrode plate is disposed on the other side of the cooling fin. A conductive terminal protrudes from one end of the electrode plate. The conductive terminal includes a warped section and a flat section. A portion of the warped section and the flat section extend in a direction perpendicular to an extending direction of the electrode plate. Accordingly, heat dissipation is accelerated, a windward area is enlarged, and the effect of blowing out a hot airflow is enhanced, thereby avoiding a temperature rise of the conductive terminal.

12 Claims, 5 Drawing Sheets

CERAMIC HEATER HAVING ENLARGED WINDWARD AREA

TECHNICAL FIELD

The present invention relates to a ceramic heater and, in particular, to a ceramic heater having an enlarged windward area.

BACKGROUND

A conventional positive temperature coefficient (PTC) thermistor is a heating element with rigidity. After powering on, an increase in temperature causes a resistance value to change, and the resistance value increases rapidly within a certain temperature range. A PTC heating element is made by performing high temperature sintering on a mixture of barium carbonate, titanium dioxide, and so forth with the addition of a small amount of rare earth elements. A low resistance value is maintained during a wide temperature range and increases steeply when the temperature is above a curie temperature (Tc). Due to this feature, the PTC heating element is extensively used in a constant temperature heater, home appliances, air conditioning/heating and a circuit protection device for automobiles.

A conventional heater mainly includes a PTC heating element, two electrode plates, and a plastic frame. The PTC heating element is accommodated in the plastic frame. The two electrode plates are attached to two sides of the plastic frame and are electrically connected to the PTC heating element, so that the PTC heating element can obtain power via the electrode plates. When the PTC heating element is powered on, the PTC heating element generates heat to achieve heating.

In the conventional heater, a conductive terminal is parallel to the electrode plates and is electrically connected to a connector terminal for obtaining power. Meanwhile, heat is continuously accumulated between the conductive terminal and the connector terminal, which makes it difficult to dissipate heat, and thus causes dangers. Accordingly, the inventor aims to overcome the problem about how to dissipate the heat generated between the conductive terminal and the connector terminal, on the basis of which the present invention is accomplished.

SUMMARY

It is an object of the present invention to provide a ceramic heater having an enlarged windward area, which enables fast heat dissipation, increases the windward area, and enhances the effect of blowing out a hot airflow, thereby avoiding a temperature rise of the conductive terminal.

Accordingly, the present invention provides a ceramic heater having an enlarged windward area. The ceramic heater comprises a conductive heat sink, at least one positive temperature coefficient (PTC) heating element, and an electrode plate. The conductive heat sink includes a cooling fin. The at least one PTC heating element is disposed on one side of the cooling fin. The electrode plate is disposed on the other side of the cooling fin. A conductive terminal protrudes from one end of the electrode plate. The conductive terminal includes a warped section and a flat section connected to the warped section. A portion of the warped section and the flat section extend in a direction perpendicular to an extending direction of the electrode plate.

It is preferable that the conductive heat sink further comprises a heat conduction plate, the heat conduction plate is disposed on one side of the cooling fin opposite to the electrode plate, and the PTC heating element is attached onto the heat conduction plate.

It is preferable that the cooling fin is a wave-shaped fin. A heat dissipation channel is formed between each two adjacent bends of the wave-shaped cooling fin. A cool airflow parallelly passes through each heat dissipation channel and becomes a hot airflow. The cool airflow is perpendicular to an extending direction of the conductive terminal to lower the temperature of the conductive terminal during operation.

In another broad embodiment, the present invention further provides a ceramic heater having an enlarged windward area. The ceramic heater includes two conductive heat sinks, a ceramic frame, and two electrode plates. The two conductive heat sinks each include a cooling fin and a heat conduction plate disposed on one side of the cooling fin. The ceramic frame is disposed between the two conductive heat sinks. The ceramic frame includes at least one PTC heating element accommodated therein. Each of two surfaces of the PTC heating element is attached to a surface of each of the two heat conduction plates. Each of the electrode plates is disposed on the other side of the cooling fin opposite to the heat conduction plate. A conductive terminal protrudes from one end of each of the electrode plates, each of the conductive terminals includes a warped section and a flat section connected to the warped section, wherein a portion of the warped section and the flat section extend in a direction perpendicular to an extending direction of the electrode plate.

It is preferable that the ceramic frame further includes a first surface, a second surface, and an accommodation hole passing through the first surface and the second surface, the accommodation hole is provided for positioning the PTC heating element, and the first surface and the second surface are attached to the two heat conduction plates respectively.

It is preferable that the ceramic heater further comprises a gap, the gap is formed between the conductive terminal of each of the electrode plates, and the conductive terminals are disposed corresponding to each other.

It is preferable that each of the conductive terminals includes a bend portion bent toward the PTC heating element, and the bend portion is vertically connected to the electrode plate, wherein the other end of each of the bend portions is connected to each of the warped sections.

It is preferable that a width of the flat section is greater than a width of the warped section, and a protruding length of the flat section is greater than or equal to a protruding length of the warped section. The width of each of the flat sections is substantially 8 millimeters, and the length of each of the flat sections is substantially 8 millimeters.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
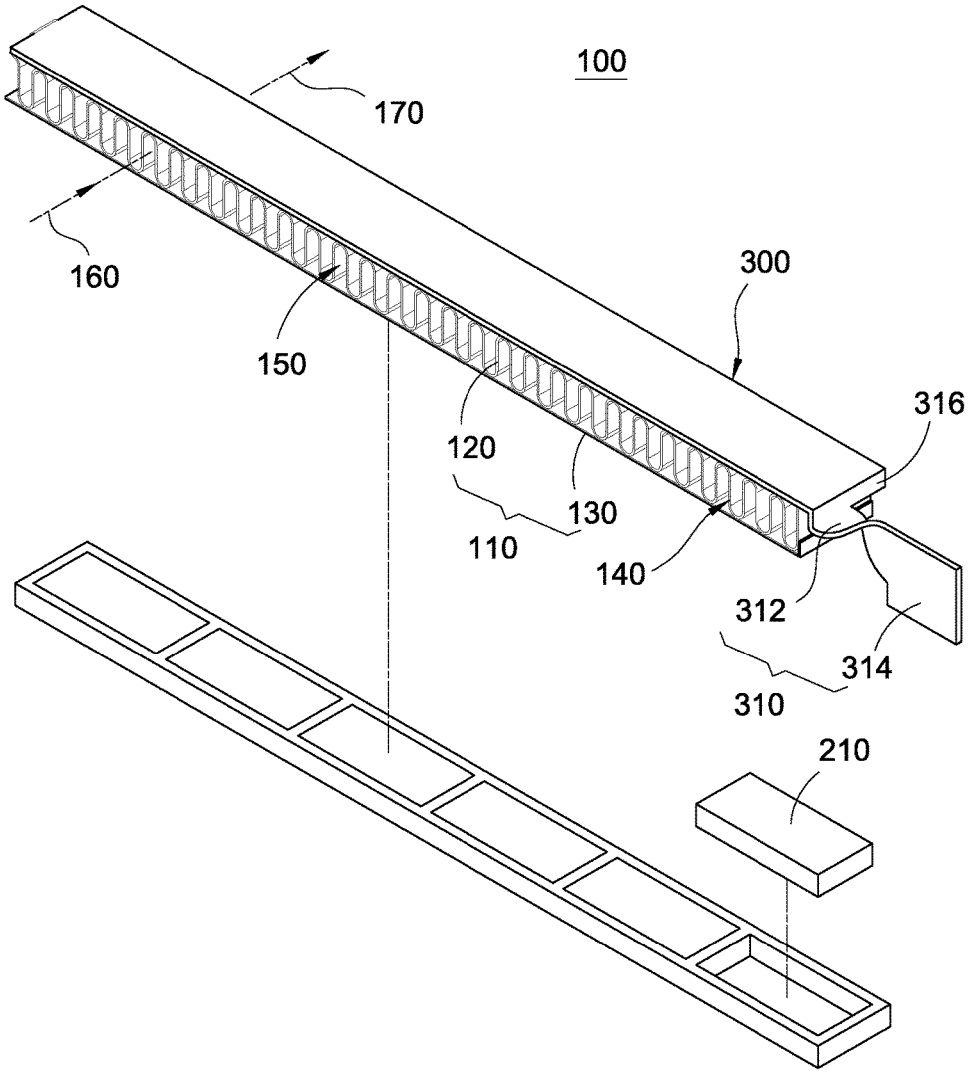
FIG. 1 is a perspective exploded view of the present invention, according to a first preferable embodiment.

FIG. 1 is a perspective exploded view of the present invention, according to a first preferable embodiment. As shown in the figure, the present invention provides a ceramic heater 100 having an enlarged windward area. The ceramic heater 100 includes a conductive heat sink 110, at least one positive temperature coefficient (PTC) heating element 210, and an electrode plate 300. The conductive heat sink 110 includes a cooling fin 120. The at least one PTC heating element 210 made from a ceramic PTC material is disposed on one side of the cooling fin 120.

As shown in FIG. 1, the electrode plate 300 is disposed on the other side of the cooling fin 120. A conductive terminal 310 protrudes from one end of the electrode plate 300, the conductive terminal 310 includes a warped section 312 and a flat section 314 connected to the warped section 312, wherein a portion of the warped section 312 and the flat section 314 extend in a direction perpendicular to an extending direction of the electrode plate 300.

In the present embodiment, the conductive terminal 310 further includes a bend portion 316 bent toward the PTC heating element 210, and the bend portion 316 is vertically connected to the electrode plate 300. The other end of the bend portion 300 is connected to the warped section 312. The width of the flat section 314 is substantially 8 millimeters, and the length of the flat section 314 is substantially 8 millimeters. The length of the warped section 312 is substantially 9 millimeters. However, in other different embodiments, the width and the length of the flat section 314 can be greater than or less than 8 millimeters, the length of the warped section 312 is not limited to 9 millimeters, the width and the length can vary according to requirements or designs.

Furthermore, the conductive heat sink 110 further includes a heat conduction plate 130. The heat conduction plate 130 is disposed on the other side of the cooling fin 120 opposite to the electrode plate 300, the PTC heating element 210 is preferably attached onto the heat conduction plate 130. In other words, the PTC heating element 210 and the electrode plate 300 are disposed on the two opposite sides of the cooling fin 120. The cooling fin 120 is preferably an integrally formed wave-shaped fin 140, so as to increase a contact area between the fin and the air, and to enhance a heat exchange effect and a heating effect of the present invention. A heat dissipation channel 150 is formed between each two adjacent bends of the wave-shaped fin 140, so the PTC heating element 210 and the electrode plate 300 are attached to two opposite sides, where the bends (not labelled) are formed, of the wave-shaped fin 140.

When the ceramic heater 100 is powered on to generate heat, a cool airflow 160 parallelly passes through each heat dissipation channel 150 and takes away the heat of the cooling fin 120 to become a hot airflow 170. As shown in the figures, a direction of the cool airflow 160 is preferably perpendicular to an extending direction of the conductive terminal 310, so as to lower the temperature of the conductive terminal 310 during operation. This configuration increases a windward area, enhances the effect of blowing out the hot airflow 170, and accelerates heat dissipation, thereby avoiding a temperature rise of the conductive terminal 310 itself.

In another broad embodiment, the present invention further provides a ceramic heater having an enlarged windward area, as shown in FIGS. 2 to 5. The ceramic heater 100 of the present embodiment comprises two conductive heat sinks 110, a ceramic frame 200 and two electrode plates 300. The two conductive heat sinks 110 each include a cooling fin 120 and a heat conduction plate 130 attached to one side of the cooling fin 120. The ceramic frame 200 is disposed between the two conductive heat sinks 110. The ceramic frame 200 includes at least one PTC heating element 210 accommodated therein. Each of two surfaces of the PTC heating element 210 is attached to a surface of each of the two heat conduction plates 130, so as to transfer heat to each of the cooling fins 120.

Figure 2:
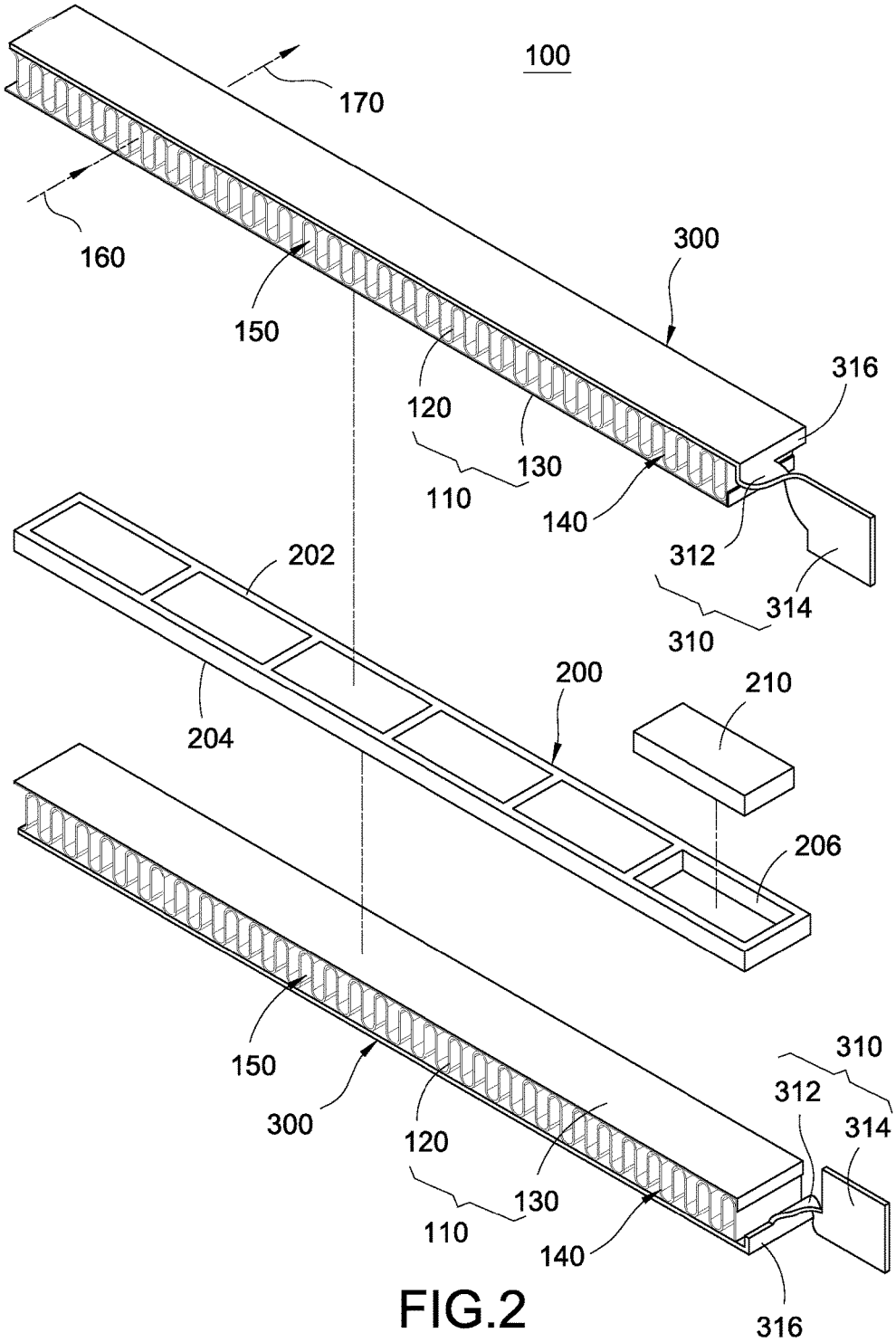
FIG. 2 is a perspective exploded view of the present invention, according to a second preferable embodiment.
Figure 4:
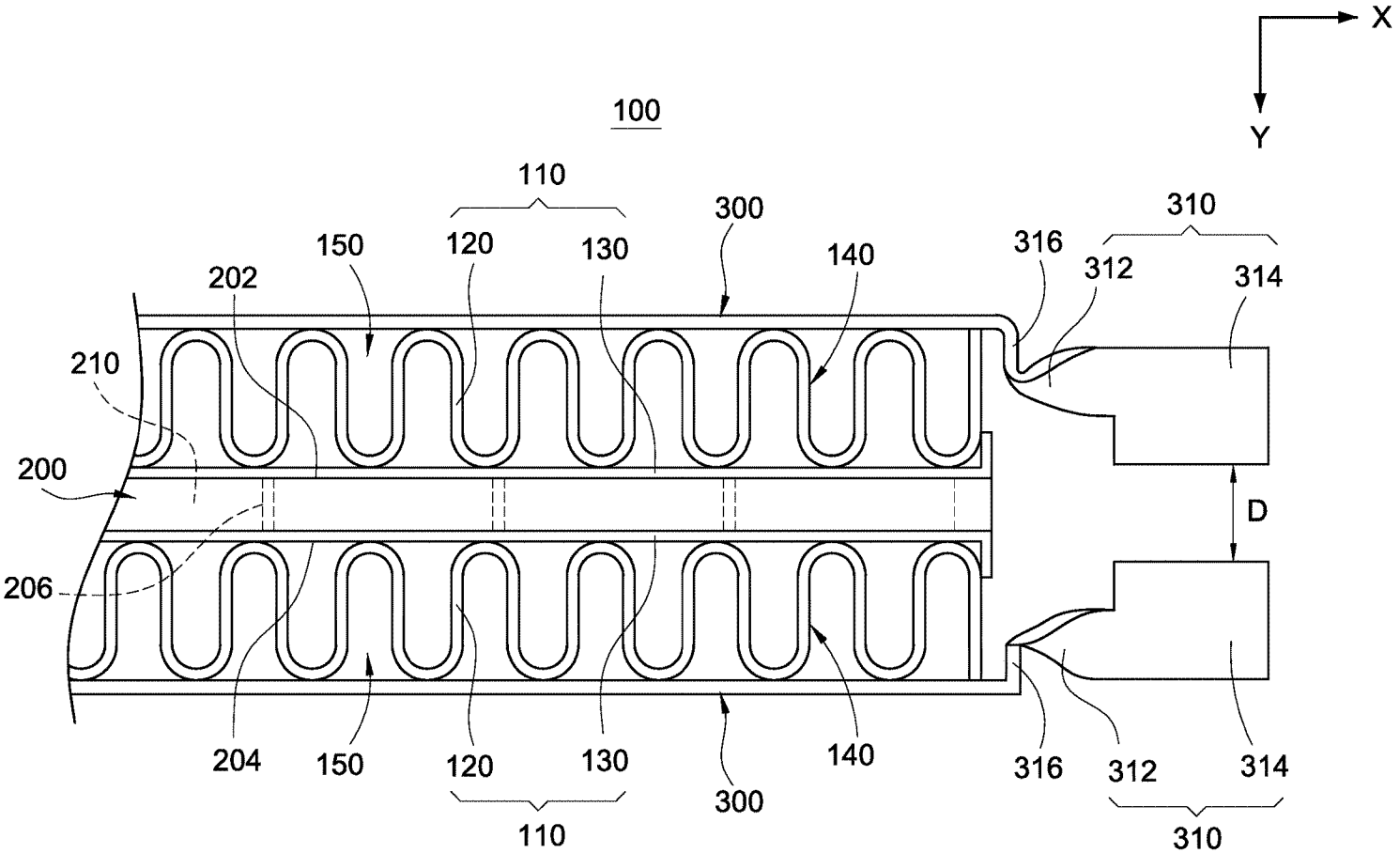
FIG. 4 is a cross-sectional view of the present invention, according to the second preferable embodiment.

Referring to FIGS. 2 and 4, the ceramic frame 200 further includes a first surface 202, a second surface 204, and an accommodation hole 206 passing through the first surface 202 and the second surface 204. The accommodation hole 206 is provided for positioning the PTC heating element 210, and the first surface 202 and the second surface 204 are attached to the two heat conduction plates 130 respectively. Furthermore, the cooling fin 120 is preferably a wave-shaped fin 140 which can increase a contact area between the air and the wave-shaped cooling fin 140, so as to enhance a heat exchange effect and a heating effect of the present embodiment. A heat dissipation channel 150 is formed between each two adjacent bends of the wave-shaped fin 140. The PTC heating element 210 and the heat conduction plate 130 are respectively attached to the two opposite sides, where the bends (not labelled) are formed, of the wave-shaped fin 140.

Each of the two electrode plates 300 is disposed on the other side of the cooling fin 120 opposite to the heat conduction plate 130. A conductive terminal 310 protrudes from one end of each of the electrode plates 300. Each of the conductive terminals 310 includes a warped section 312 and a flat section 314 connected to the warped section 312, wherein a portion of the warped section 312 and the flat section 314 extend in a direction perpendicular to an extending direction of the electrode plate 300.

Figure 3:
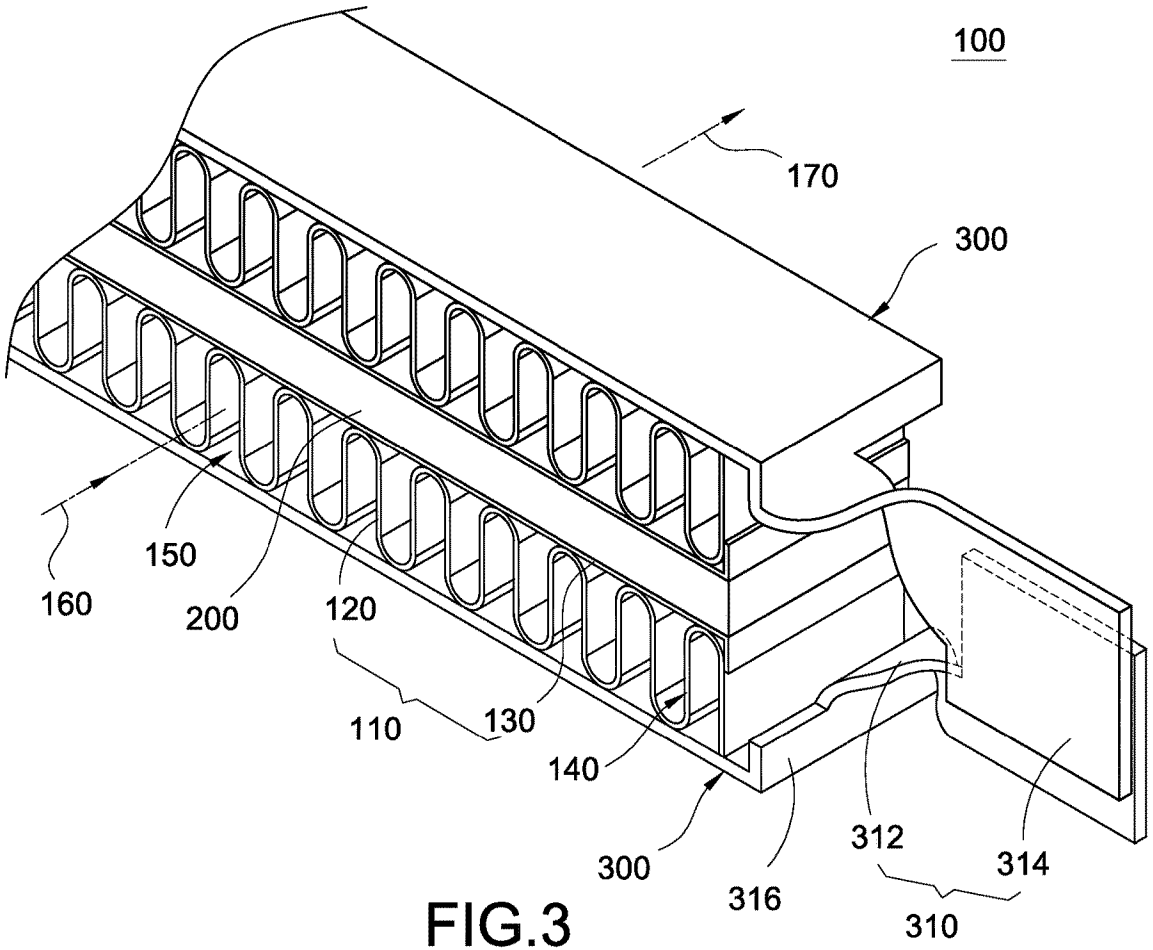
FIG. 3 is a perspective assembled view of the present invention, according to the second preferable embodiment.

Referring FIG. 3, when each PTC heating element 210 is powered on to generate heat and the heat is transferred to each conductive heat sink 110, a cool airflow 160 parallelly passes through each heat dissipation channel 150 and takes away the heat of each cooling fin 120 to become a hot airflow 170. A direction of the cool airflow 160 is preferably perpendicular to an extending direction of the conductive terminal 310, thereby increasing a windward area, enhancing the effect of blowing out the hot airflow 170, and lowering the temperature of the conductive terminal 310 during operation. This configuration accelerates heat dissipation, so the temperature of the conductive terminal 310 itself is not increased, and consequently a life span is prolonged.

Figure 5:
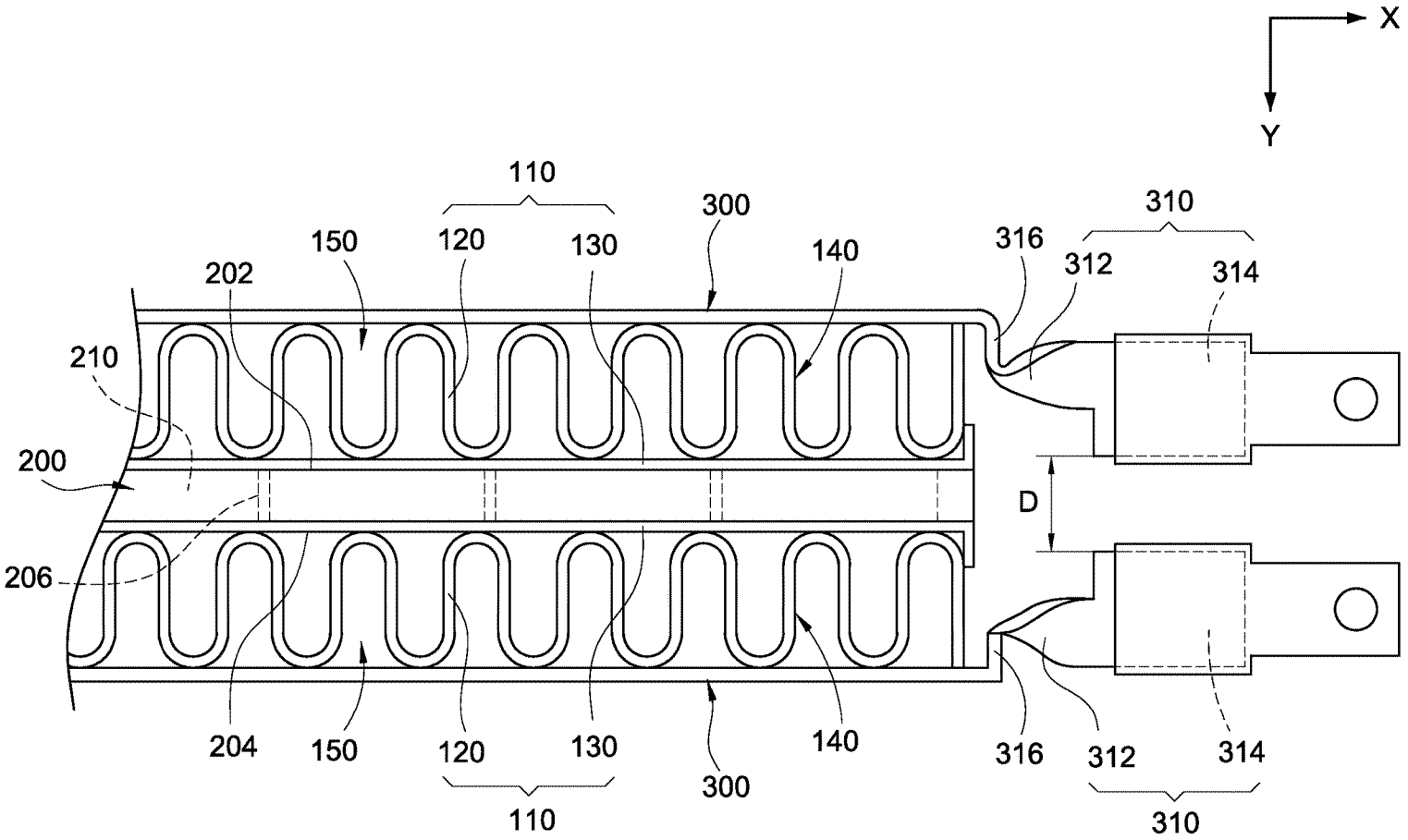
FIG. 5 is a cross-sectional view of the present invention illustrating externally connecting a power terminal according to the second preferable embodiment.

Referring to FIGS. 4 and 5, the ceramic heater 100 further comprises a gap D so as to facilitate connecting to each external power terminal, the gap D is formed between the conductive terminal 310 of each of the two electrode plates 300, and the conductive terminals 310 are disposed correspondingly to each other. When the flat section 314 of each of the conductive terminals 310 is electrically coupled to each external power terminal (i.e. an anode and a cathode of an external power source), the two conductive terminals 310 protrude in the same direction, thereby facilitating connecting to the external power source (not illustrated). However, in other different embodiments, the conductive terminals 310 can protrude in opposite directions, and the protruding directions may vary according to requirements, so as to prevent the gap D from being too small to cause a short circuit.

Furthermore, each of the conductive terminals 316 further includes a bend portion 316 bent toward the PTC heating element 210, the bend portion 316 is vertically connected to the electrode plate 300, and the other end of each of the bend portions 316 is connected to each of the warped sections 312. As shown in FIGS. 4 and 5, a width (i.e. a Y direction) of the flat section 314 is preferably greater than a width of the warped section 312, and a protruding length (i.e. an X direction) of the flat section 314 is preferably greater than or equal to a protruding length of the warped section 312.

Moreover, the width and the length of each of the flat sections 314 are both substantially 8 millimeters, and the length of each of the warped section 312 is substantially 8 millimeters. However, in other different embodiments, the width and the length of the flat section 314 can be greater than or less than 8 millimeters, the length of the warped section 312 is not limited to 9 millimeters, and the width and the length can vary according to requirements or designs.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A ceramic heater having an enlarged windward area, comprising:

a conductive heat sink (110) including a cooling fin (120);

at least one positive temperature coefficient (PTC) heating element (210) disposed on a first side of the cooling fin (120); and an electrode plate (300) disposed on a second side of the cooling fin (120), the first side being opposite to the second side, a conductive terminal (310) protruding from one end of the electrode plate (300), the conductive terminal (310) including a twisted section (312) and a flat section (314) connected to the twisted section (312), wherein a portion of a surface of the twisted section (312) and a surface of the flat section (314) are perpendicular to a major planar surface of the electrode plate (300).

2. The ceramic heater of claim 1, wherein the conductive heat sink (110) further comprises a heat conduction plate (130), the heat conduction plate (130) is disposed on the first side of the cooling fin (120) opposite to the electrode plate (300), the PTC heating element (210) is in contact with the heat conduction plate (130).

3. The ceramic heater of claim 1, wherein the conductive terminal (310) further includes a bend portion (316) bent toward the PTC heating element (210), and the bend portion (316) is vertically connected to the electrode plate (300).

4. The ceramic heater of claim 3, wherein the other end of the bend portion (316) is connected to the twisted section (312).

5. The ceramic heater of claim 1, wherein a width of the flat section (314) is greater than a width of the twisted section (312), and a protruding length of the flat section (314) is greater than or equal to a protruding length of the twisted section (312).

6. The ceramic heater of claim 5, wherein the width of the flat section (314) is substantially 8 millimeters, and the length of the flat section (314) is substantially 8 millimeters.

7. A ceramic heater having an enlarged windward area, comprising:

two conductive heat sinks (110), each of the conductive heat sinks (110) including a cooling fin (120) and a heat conduction plate (130) attached to a side of the cooling fin (120);

a ceramic frame (200) disposed between the two conductive heat sinks (130), the ceramic frame (200) including at least one PTC heating element (210) accommodated therein, each of two surfaces of the PTC heating element (210) being in contact with a surface of each of the two heat conduction plates (130); and two electrode plates (300), each of the electrode plates (300) being disposed on the other side of the cooling fin (120) opposite to the heat conduction plate (130), a conductive terminal (310) protruding from one end of each of the electrode plates (300), each of the conductive terminals (310) including a twisted section (312) and a flat section (314) connected to the twisted section (312), wherein a portion of a surface of the twisted section (312) and a surface of the flat section (314) are perpendicular to a major planar surface of the electrode plate (300).

8. The ceramic heater of claim 7, wherein the ceramic frame (200) further includes a first surface (202), a second surface (204), and an accommodation hole (206) passing through the first surface (202) and the second surface (204), the accommodation hole (206) is provided for positioning the PTC heating element (210), and the first surface (202) and the second surface (204) are attached to the two heat conduction plates (130) respectively.

9. The ceramic heater of claim 7, further comprising a gap (D), the gap (D) being formed between the conductive terminal (310) of each of the two electrode plates (300).

10. The ceramic heater of claim 7, wherein each of the conductive terminals (310) further includes a bend portion (316) bent toward the PTC heating element (210), and the bend portion (316) is vertically connected to the electrode plate (300).

11. The ceramic heater of claim 10, wherein the other end of each of the bend portions (316) is connected to each of the twisted sections (312).

12. The ceramic heater of claim 7, wherein the width of each of the flat sections (314) is substantially 8 millimeters, and the length of each of the flat sections (314) is substantially 8 millimeters.

* * * * *